US006729806B1

(12) United States Patent
Knight

(10) Patent No.: US 6,729,806 B1
(45) Date of Patent: May 4, 2004

(54) CRIB PLATFORM DEVICE, KIT AND METHOD OF USING

(76) Inventor: Jason E. Knight, 26816 Neff Ct., Canyon Country, CA (US) 91351

( * ) Notice: Subject to any disclaimer, the term of this patent is extended or adjusted under 35 U.S.C. 154(b) by 0 days.

(21) Appl. No.: 10/354,462

(22) Filed: Jan. 29, 2003

(51) Int. Cl.[7] ..... E02D 29/00; E21D 15/48

(52) U.S. Cl. ..... 405/288; 405/273; 405/284; 299/11

(58) Field of Search ..... 405/272, 273, 405/284, 285, 288; 446/106, 85; 52/233; 299/11

(56) References Cited

U.S. PATENT DOCUMENTS 1,773,579 A * 8/1930 Flath ..... 405/273
2,197,960 A * 4/1940 Alexander ..... 405/273
4,497,075 A * 2/1985 Niwa et al. ..... 424/423
D279,030 S * 5/1985 Risi et al. ..... D25/113
5,746,547 A * 5/1998 Reinmann et al. ..... 405/288
6,250,849 B1 * 6/2001 Marianski et al. ..... 405/273

* cited by examiner

*Primary Examiner*—Robert E. Pezzuto
*Assistant Examiner*—Tara L. Mayo

(57) ABSTRACT

A crib platform device, kit and associated method of using for building a temporary buttress underneath an overhanging obstruction. The crib employs a two platforms, and a lock bar for reversibly locking together the platforms. Alternatively, the platforms may be mated by connecting blocks of one platform unit to beams of the other platform, and locked together with a lock beam traversing through the mated blocks and beams of the platforms. The unassembled components of the device form a kit. The method of using comprises the steps of adjusting, aligning, carrying, crawling, dropping, grabbing, mating, obtaining, positioning, placing, pulling, putting, reposing, sliding, taking, and wearing.

20 Claims, 3 Drawing Sheets

CRIB PLATFORM DEVICE, KIT AND METHOD OF USING

FIELD OF THE INVENTION

The present invention relates to crib devices, more particularly to a crib platform device kit and method of using the device for as a rapid and convenient means for erecting a temporary buttress underneath an overhanging obstruction.

DESCRIPTION OF THE PRIOR ART

Rescue squads face a number of challenging task to search for trapped people in collapsed building. One primary goal of rescue team members is not to become a victim as well. Therefore, it is vital to stabilized potentially dangerous crevices by using crib devices to build temporary buttresses over various entrances prior to insertion of rescue team members through these crevices. A wide variety of crib devices is currently available on the commercial market and an even larger number of these types of devices are known in the art of crib devices, for example, the cribbing disclosed by Flath in U.S. Pat. No. 1,773,579; the cribbing disclosed by Alexander in U.S. Pat. No. 2,197,960; the filler for filling in defects or hollow portions of bones disclosed by Niwa et al. in U.S. Pat. No. 4,497,075; the mine support crib disclosed by Reinmann and McCartney in U.S. Pat. No. 5,746,547; the interconnected cribbing system disclosed by Marianski and Marianski in U.S. Pat. No. 6,250,849; and the header for cribbing disclosed by Risi and Risi in U.S. Pat. No. D279,030.

While all of the above-described devices fulfill their respective, particular objectives and requirements, the aforementioned patents do not describe a crib platform device having a first platform unit, a second platform unit, and a lock bar reversibly locking together the first platform unit to the second platform unit, in which the second platform unit has a flexible strap. This combination of elements would specifically match the user's particular individual needs of making it possible to conveniently tote this device to a work site in order to rapidly use this device to build a temporary buttress underneath an overhanging obstruction. The above-described patents make no provision for a crib platform device having a first platform unit, a second platform unit, and a lock bar reversibly locking together the first platform unit to the second platform unit, in which the second platform unit has a flexible strap.

Therefore, a need exists for a new and improved crib platform device having a first platform unit, a second platform unit, and a lock bar reversibly locking together the first platform unit to the second platform unit, in which the second platform unit has a flexible strap. In this respect, the crib platform device according to the present invention substantially departs from the conventional concepts and designs of the prior art, and in doing so provides an apparatus primarily developed for the purpose of providing a means for conveniently toting a crib platform device to a work site in order to rapidly use this device to as a means for building a temporary buttress underneath an overhanging obstruction.

SUMMARY OF THE INVENTION

The present device, kit and method of using, according to the principles of the present invention, overcomes the shortcomings of the prior art by providing a crib platform device, kit and method of using is disclosed. The device comprises a first platform unit, a second platform unit, and a lock bar reversibly locking together the first platform unit to the second platform unit. The first platform unit comprises a generally flat panel and a plurality of elongated blocks attached to the top surface of the panel in which each block is aligned substantially parallel to each other block and spaced apart from each other block by a distance of at least the width of each block. The second platform unit comprises a flexible strap and a plurality of elongated beams attached to the flexible strap 26 in which each beam is also aligned substantially parallel to each other beam and spaced apart from each others beam by a distance of at least the width of each beam. The first and second platform units may be mated together by connecting together the blocks of the first platform unit alternately together with the plurality of beams of the second platform unit. The first and second platform units may be locked together with a lock beam traversing through the mated plurality of blocks and beams, respectively. The kit comprises the unassembled components of the device. The method of using comprises the steps of adjusting, aligning, carrying, crawling, dropping, grabbing, mating, obtaining, positioning, placing, pulling, putting, reposing, sliding, taking, and wearing.

In view of the foregoing disadvantages inherent in the known type crib platform devices now present in the prior art, the present invention provides an improved crib platform device, which will be described subsequently in great detail, is to provide a new and improved crib platform device which is not anticipated, rendered obvious, suggested, or even implied by the prior art, either alone or in any combination thereof.

To attain this, the present invention essentially comprises a first platform unit, a second platform unit, and a lock bar reversibly locking together the first platform unit to the second platform unit. The first platform unit comprises a generally flat panel and a plurality of elongated blocks attached to the top surface of the panel in which each block is aligned substantially parallel to each other block and spaced apart from each other block by a distance of at least the width of each block. The second platform unit comprises a flexible strap and a plurality of elongated beams attached to the flexible strap 26 in which each beam is also aligned substantially parallel to each other beam and spaced apart from each others beam by a distance of at least the width of each beam. The first and second platform units may be mated together by connecting together the blocks of the first platform unit alternately together with the plurality of beams of the second platform unit. The first and second platform units may be locked together with a lock beam traversing through the mated plurality of blocks and beams, respectively.

There has thus been outlined, rather broadly, the more important features of the invention in order that the detailed description thereof that follows may be better understood, and in order that the present contribution of the art may be better appreciated.

Numerous objects, features and advantages of the present invention will be readily apparent to those of ordinary skill in the art upon reading of the following detailed description of presently preferred, but nonetheless illustrative, embodiments of the present invention when taken in conjunction with the accompany drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved crib platform device that has all the advantages of the prior art crib platform device and none of the disadvantages.

It is another object of the present invention to provide a new and improved crib platform device that may be easily and efficiently manufactured and marketed.

An even further object of the present invention is to provide a new and improved crib platform device that has a low cost of manufacture with regard to both materials and labor, and which accordingly is then susceptible of low prices of sale to the consuming public, thereby making such multipurpose storage unit and system economically available to the buying public.

Still another object of the present invention is to provide a new crib platform device that provides in the apparatuses and methods of the prior art some of the advantages thererof, while simultaneously overcoming some of the disadvantages normally associated therewith.

Even still another object of the present invention is to provide a crib platform device having a first platform unit, a second platform unit, and a lock bar reversibly locking together the first platform unit to the second platform unit, in which the second platform unit has a flexible strap. This combination of elements makes it possible to conveniently tote this device to a work site in order to rapidly use this device to build a temporary buttress underneath an overhanging obstruction.

Still another object of the present invention is to provide a kit comprising the unassembled components of the device.

Lastly, it is an object of the present invention to provide a new and improved method of using comprises the steps of adjusting, aligning, carrying, crawling, dropping, grabbing, mating, obtaining, positioning, placing, pulling, putting, reposing, sliding, taking, and wearing.

Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and description matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DETAILED DESCRIPTION OF THE PREFERRED EMBODIMENT

Figure 1:
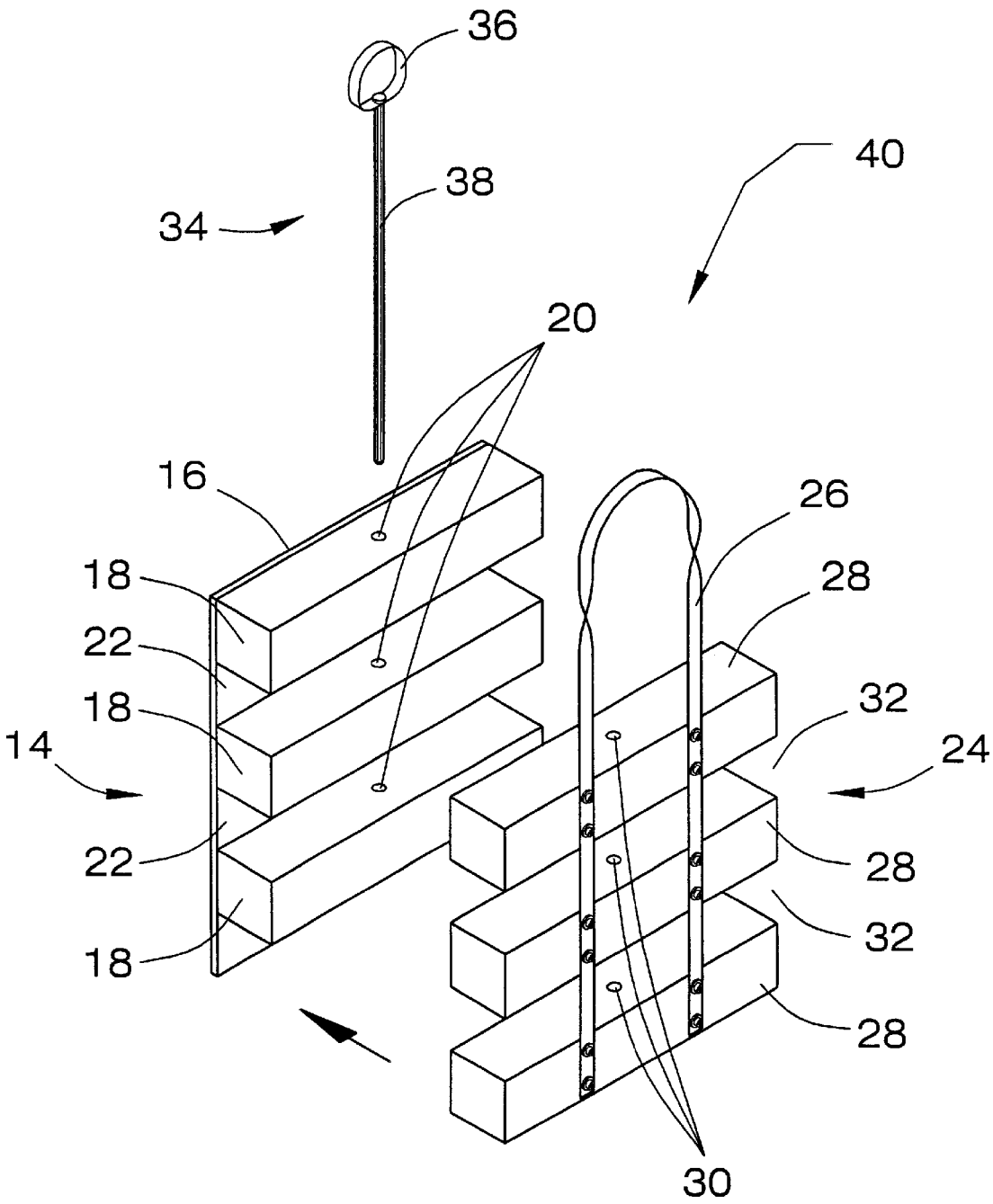
FIG. 1 is a perspective view of a preferred embodiment of the kit for assembling the crib platform device constructed in accordance with the principles of the present invention.
Figure 2:
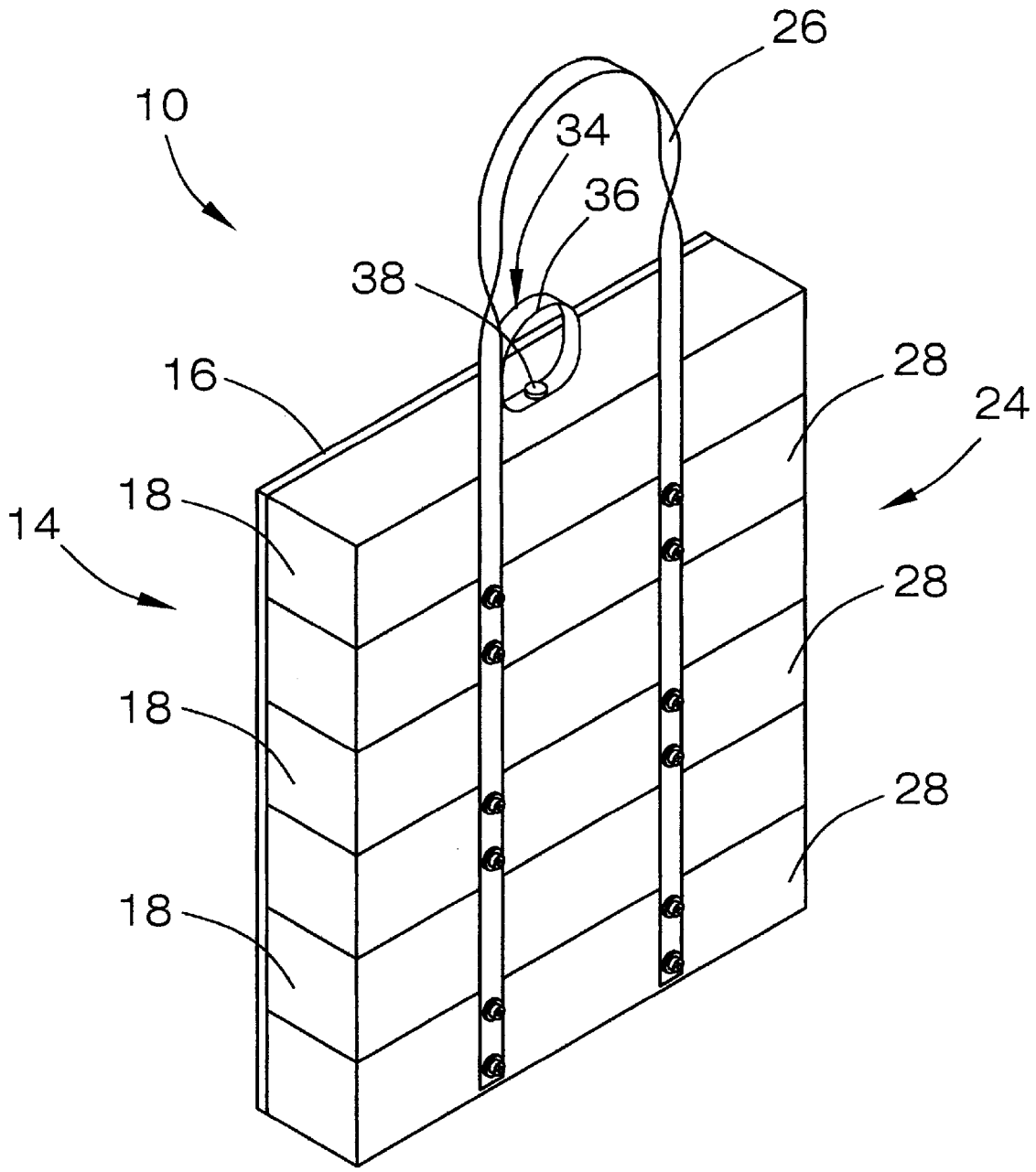
FIG. 2 is a perspective view of a preferred embodiment of the crib platform device of the present invention.
Figure 3:
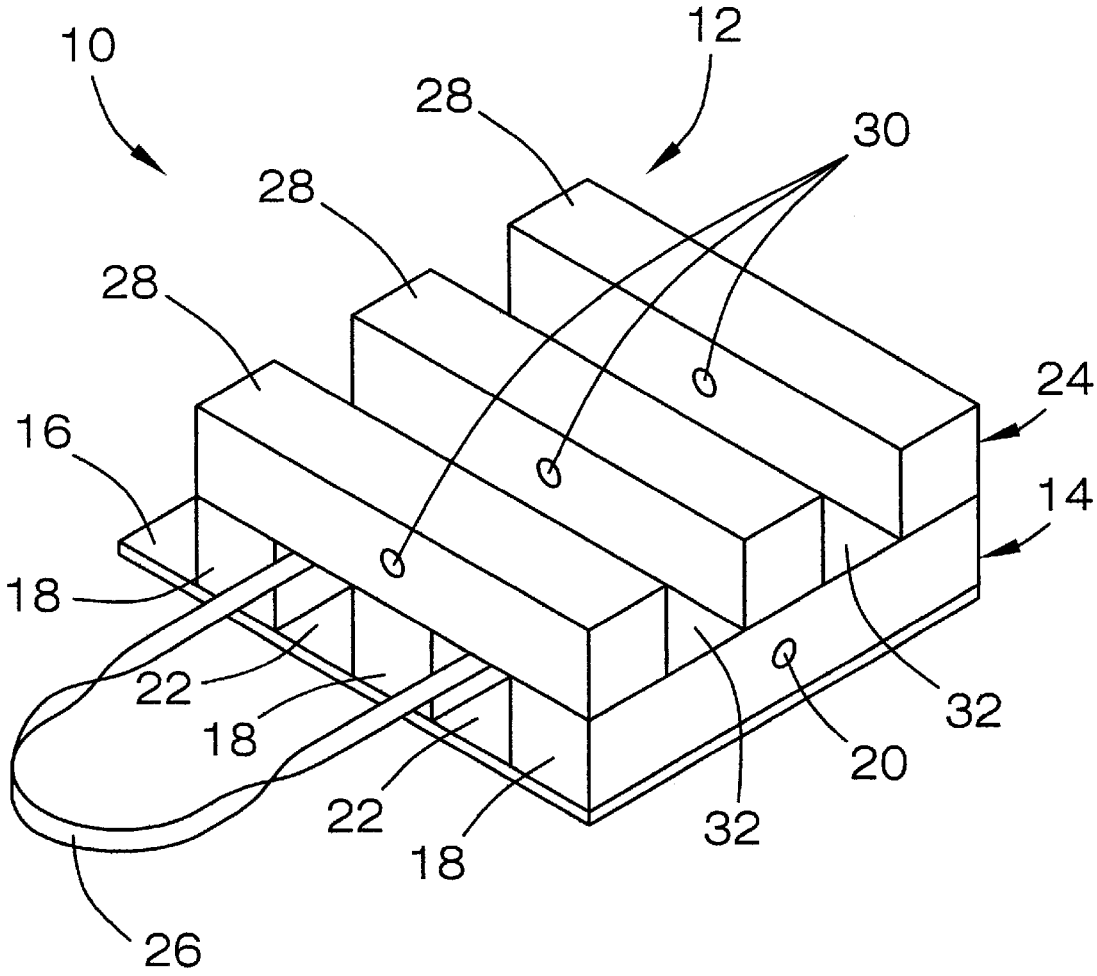
FIG. 3 is a perspective view of the buttress built from a preferred embodiment of the crib platform device of the present invention.

Referring now to the drawings, and in particular FIG. 1 to 3 thereof, one preferred embodiment of the present invention is shown and generally designated by the reference numeral 10. One preferred embodiment of a crib platform device 10 for use in providing a means for building a temporary buttress 12 underneath an overhanging obstruction, the device 10 comprises a first platform unit 14, a second platform unit 24, and a lock bar 34 reversibly locking together the first platform unit 14 to the second platform unit 24. The first platform unit 14 comprises: a generally flat panel 16 and a plurality of elongated blocks 18 attached to the top surface of the panel 16. The generally flat panel 16 has a top surface, a bottom surface, a length and a width. Each block 18 has a width with a given thickness, a height, a length and an internal collar defining a hole 20 traversing through the width of each block 18. Each block 18 is aligned on the panel 16 so that the holes 20 in the plurality of blocks 18 define an imaginary line. Each block 18 is also aligned substantially parallel to each other block 18 and spaced apart from each other block 18 by a distance of at least the given thickness of the width of each block 18 whereby each pair of adjacent blocks 18 defines a channel 22 between each pair of adjacent blocks 18 wherein the channel 22 having a width of at least the given thickness of the width of any given block 18. The second platform unit 24 comprises a flexible strap 26 and a plurality of elongated beams 28 attached to the flexible strap 26. Each beam 28 has a width with the given thickness, a height, a length and an internal sleeve defining an orifice 30 traversing through the width of each beam 28. Each beam 28 is aligned on the flexible strap 26 so that the orifices 30 in the plurality of beams 28 lie along the imaginary line. Each beam 28 is also aligned substantially parallel to each other beam 28 and spaced apart from each other beam 28 by a distance of at least the given thickness of the width of each beam 28 whereby each pair of adjacent beams 28 defines a gap 32 between each pair of adjacent beams 28 having a width of at least the given thickness of the width of any given beam 28. The lock bar 34 comprises a handle 36; and a rod 38 attached to the handle 36. The rod 38 is slidably inserted within the hole 20 of each block 18 of the plurality of blocks 18 of the first platform unit 14 and slidably inserted within the orifice 30 of each beam 28 of the plurality of beams 28 of the second platform unit 24, whereby locking the first and second platform units (14 and 24 respectfully) together.

The strap 26 may be mounted onto the beams 28 in any commercially known configuration. One preferred configuration is that the strap 26 is looped around the plurality of beams 28 defining a shoulder harness. The strap 26 may be made of any commercially available material. One preferred configuration of the strap 26 is that it is made of material selected from the group consisting of leather, hemp, cotton, nylon, polyester, polypropylene, polyurethanes, polyacryls, polymethacryls, cellulosic polymers, styrene-acryl copolymers, polystyrene-polyacryl mixtures, polysiloxanes, urethane-acryl copolymers, siloxane-urethane copolymers, polyurethane-polymethacryl mixtures, silicone-acryl copolymers, vinyl acetate polymers, and mixtures thereof.

The shape of the flat panel 16 may be any commercially known shape and configuration. One preferred configuration of the length of the flat panel 16 is that it is substantially the same distance across as the width of the flat panel 16, whereby the flat panel 16 is substantially shaped as a square.

The shape of each block 18 may be any commercially known shape and configuration. One preferred configuration of the height of each block 18 is that it is substantially the same distance across as the width of each block 18, whereby each block 18 is substantially shaped as an elongated square block 18. One preferred configuration of the length of each block 18 is that it is substantially the same distance as the length of the panel 16. One preferred configuration of the height of each beam 28 is that it is substantially the same distance across as the width of each beam 28, whereby each beam 28 is substantially shaped as an elongated square beam 28.

The shape of each beam 28 may be any commercially known shape and configuration. One preferred configuration of the length of each beam 28 is that it is substantially the same distance as the length of the panel 16. A more preferred configuration of the length, width and height of each block 18 is substantially the same dimensions of the length, width and height of each beam 28. A most preferred configuration of the length of each block 18 and each beam 28 is that they are approximately twenty inches, the width of each block 18 and each beam 28 is approximately four inches, the height of each block 18 and each beam 28 is approximately four inches.

One preferred embodiment of a kit 40 for assembling a crib platform device 10 for use in providing a means for building a temporary buttress 12 underneath an overhanging obstruction, the kit 40 comprising: a first platform unit 14, a second platform unit 24, and a lock bar 34 capable of attaching together the first platform unit 14 to the second platform unit 24. The first platform unit 14 comprising: a generally flat panel 16 having a top surface, a bottom surface, a length and a width; and a plurality of elongated blocks 18 attached to the top surface of the panel 16, each block 18 having a width with a given thickness, a height, a length and an internal collar defining a hole 20 traversing through the width of each block 18, wherein each block 18 is aligned on the panel 16 so that the holes 20 in the plurality of blocks 18 define an imaginary line, each block 18 is also aligned substantially parallel to each other block 18 and spaced apart from each other block 18 by a distance of at least the given thickness of the width of each block 18 whereby each pair of adjacent blocks 18 defines a channel 22 between each pair of adjacent blocks 18 wherein the channel 22 having a width of at least the given thickness of the width of any given block 18. The second platform unit 24 comprising: a flexible strap 26; and a plurality of elongated beams 28 attached to the flexible strap 26, each beam 28 having a width with the given thickness, a height, a length and an internal sleeve defining an orifice 30 traversing through the width of each beam 28, wherein when the flexible strap 26 is taut lengthwise then each beam 28 is aligned on the flexible strap 26 so that the orifices 30 in the plurality of beams 28 lie along the imaginary line, when the flexible strap 26 is taut lengthwise then each beam 28 is also aligned substantially parallel to each other beam 28 and spaced apart from each other beam 28 by a distance of at least the given thickness of the width of each beam 28 whereby each pair of adjacent beams 28 defines a gap 32 between each pair of adjacent beams 28 having a width of at least the given thickness of the width of any given beam 28. The lock bar 34 comprising: a handle 36; and a rod 38 attached to the handle 36, wherein the rod 38 is slidably insertable within the hole 20 of each block 18 of the plurality of blocks 18 of the first platform unit 14 and slidably insertable within the orifice 30 of each beam 28 of the plurality of beams 28 of the second platform unit 24, whereby the lock bar 34 is capable of locking the first and second platform units (14 and 24 respectfully) together.

One preferred method of using a kit 40 for assembling a crib platform device 10 for use in providing a means for building a temporary buttress 12 underneath an overhanging obstruction, the method comprising the steps of adjusting, aligning, carrying, crawling, dropping, grabbing, mating, obtaining, positioning, placing, pulling, putting, reposing, sliding, taking, and wearing. The obtaining step comprises obtaining the kit 40 comprising:a first platform unit 14 comprising: a generally flat panel 16 having a top surface, a bottom surface, a length and a width; and a plurality of elongated blocks 18 attached to the top surface of the panel 16, each block 18 having a width with a given thickness, a height, a length and an internal collar defining a hole 20 traversing through the width of each block 18, wherein each block 18 is aligned on the panel 16 so that the holes 20 in the plurality of blocks 18 define an imaginary line, each block 18 is also aligned substantially parallel to each other block 18 and spaced apart from each other block 18 by a distance of at least the given thickness of the width of each block 18 whereby each pair of adjacent blocks 18 defines a channel 22 between each pair of adjacent blocks 18 wherein the channel 22 having a width of at least the given thickness of the width of any given block 18; a second platform unit 24 comprising: a flexible strap 26; and a plurality of elongated beams 28 attached to the flexible strap 26, each beam 28 having a width with the given thickness, a height, a length and an internal sleeve defining an orifice 30 traversing through the width of each beam 28, wherein when the flexible strap 26 is taut lengthwise then each beam 28 is aligned on the flexible strap 26 so that the orifices 30 in the plurality of beams 28 lie along the imaginary line, when the flexible strap 26 is taut lengthwise then each beam 28 is also aligned substantially parallel to each other beam 28 and spaced apart from each other beam 28 by a distance of at least the given thickness of the width of each beam 28 whereby each pair of adjacent beams 28 defines a gap 32 between each pair of adjacent beams 28 having a width of at least the given thickness of the width of any given beam 28, wherein the strap 26 looped around the plurality of beams 28 defining a shoulder harness; and a lock bar 34 comprising: a handle 36; and a rod 38 attached to the handle 36, wherein the rod 38 is slidably insertable within the hole 20 of each block 18 of the plurality of blocks 18 of the first platform unit 14 and slidably insertable within the orifice 30 of each beam 28 of the plurality of beams 28 of the second platform unit 24, whereby the lock bar 34 is capable of locking the first and second platform units (14 and 24 respectfully) together. The placing step comprises placing the bottom surface of the panel 16 of the first platform unit 14 onto a table top so that each block 18 is facing upwards relative to the table top. The mating step comprises mating the first platform unit 14 to the second platform unit 24 so that the plurality of blocks 18 of the first platform unit 14 alternately fit together with the plurality of beams 28 of the second platform unit 24. The aligning step comprises aligning the holes 20 of the plurality of blocks 18 of the first platform unit 14 with the orifices 30 of the plurality of beams 28 of the second platform unit 24 along the imaginary line when the first platform unit 14 is mated to the second platform unit 24. The sliding step comprises sliding the rod 38 of the lock bar 34 into the aligned holes 20 of the plurality of blocks 18 of the first platform unit 14 and into the aligned orifices 30 of the plurality of beams 28 of the second platform unit 24, whereby the steps of obtaining, placing, mating, aligning and sliding constitute assembling the device 10 from the kit 40. The wearing step comprises wearing the shoulder harness of the flexible strap 26 of the device 10 over a shoulder to hoist up the device 10. The carrying step comprises carrying the device 10 to a given work site while wearing the shoulder harness of the flexible strap 26 of the device 10 over the shoulder. The taking step comprises taking off the shoulder harness of the flexible strap 26 of the device 10 from over the shoulder. The dropping step comprises dropping the device 10 down on a work surface. The grabbing step comprises grabbing hold of the handle 36 of the lock bar 34 of the device 10. The pulling step comprises pulling the handle 36 of the lock bar 34 from the device 10 to remove the rod 38 from the device 10, whereby unlocking the first platform unit 14 from the second platform unit 24 of the device 10. The putting step comprises putting down the lock bar 34 in a safe place. The positioning step comprises positioning the bottom surface of the first platform unit 14 underneath the overhanging obstruction so that each block 18 is facing upwards relative to the overhanging obstruction. The reposing step comprises reposing the second platform unit 24 on top of the first platform unit 14 positioned underneath the overhanging obstruction. The adjusting step comprises adjusting the beams 28 of the second platform unit 24 in a substantially perpendicular alignment relative to the blocks 18 of the first platform unit 14 positioned underneath the overhanging obstruction whereby the positioning, reposing and adjusting steps constitute constructing building the temporary buttress 12 underneath a portion of the overhanging obstruction. The crawling step comprises crawling underneath the overhanging obstruction when the temporary buttress 12 is built underneath a portion of the overhanging obstruction.

Referring now to FIG. 1 which depicts a perspective view of an preferred embodiment of the kit 40 showing a first platform unit 14, a second platform unit 24, and a lock bar 34 capable of attaching together the first platform unit 14 to the second platform unit 24. Also shown is the flexible strap 26 looped around the plurality of beams 28 defining a shoulder harness.

Referring now to FIG. 2 which depicts a perspective view of a preferred embodiment of the crib platform device 10 showing a first platform unit 14 mated together with a second platform unit 24, and a lock bar 34 locking together the first platform unit 14 to the second platform unit 24. Also shown is the flexible strap 26 looped around the plurality of beams 28 defining a shoulder harness.

Referring now to FIG. 3 which depicts a buttress 12 built from a preferred embodiment of the crib platform device 10 showing a second platform unit 24 reposed on top of a first platform unit 14 so that the beams 28 of the second platform unit 24 are substantially perpendicular aligned relative to the blocks 18 of the first platform unit 14. Also shown is the flexible strap 26 looped around the plurality of beams 28 defining a shoulder harness.

As to the manner of usage and operation of the present invention, the same should be apparent from the above description. Accordingly, no further discussion relating to the manner of usage and operation will be provided.

While a preferred embodiment of the crib platform device has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Throughout this specification, unless the context requires otherwise, the word "comprise" or variations such as "comprises" or "comprising" or the term "includes" or variations, thereof, or the term "having" or variations, thereof will be understood to imply the inclusion of a stated element or integer or group of elements or integers but not the exclusion of any other element or integer or group of elements or integers. In this regard, in construing the claim scope, an embodiment where one or more features is added to any of the claims is to be regarded as within the scope of the invention given that the essential features of the invention as claimed are included in such an embodiment.

Those skilled in the art will appreciate that the invention described herein is susceptible to variations and modifications other than those specifically described. It is to be understood that the invention includes all such variations and modifications which fall within its spirit and scope. The invention also includes all of the steps, features, compositions and compounds referred to or indicated in this specification, individually or collectively, and any and all combinations of any two or more of said steps or features.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A crib platform device for use in providing a means for building a temporary buttress underneath an overhanging obstruction, said device comprising:

a first platform unit comprising:

a generally flat panel having a top surface, a bottom surface, a length and a width; and a plurality of elongated blocks attached to the top surface of said panel, each block having a width with a given thickness, a height, a length and an internal collar defining a hole traversing through the width of each block, wherein each block is aligned on said panel so that the holes in said plurality of blocks define an imaginary line, each block is also aligned substantially parallel to each other block and spaced apart from each other block by a distance of at least the given thickness of the width of each block whereby each pair of adjacent blocks defines a channel between each pair of adjacent blocks wherein the channel having a width of at least the given thickness of the width of any given block;

a second platform unit comprising:

a flexible strap; and a plurality of elongated beams attached to said flexible strap, each beam having a width with the given thickness, a height, a length and an internal sleeve defining an orifice traversing through the width of each beam, wherein each beam is aligned on said flexible strap so that the orifices in said plurality of beams lie along the imaginary line, each beam is also aligned substantially parallel to each other beam and spaced apart from each other beam by a distance of at least the given thickness of the width of each beam whereby each pair of adjacent beams defines a gap between each pair of adjacent beams having a width of at least the given thickness of the width of any given beam; and a lock bar comprising:

a handle; and a rod attached to said handle, wherein said rod is slidably inserted within the hole of each block of said plurality of blocks of said first platform unit and slidably inserted within the orifice of each beam of said plurality of beams of said second platform unit, whereby locking said first and second platform units together.

2. The device of claim 1 wherein said strap looped around said plurality of beams defining a shoulder harness.

3. The device of claim 1 wherein the length of said flat panel is substantially the same distance across as the width of said flat panel, whereby said flat panel is substantially shaped as a square.

4. The device of claim 1 wherein the height of each block is substantially the same distance across as the width of each block, whereby each block is substantially shaped as an elongated square block.

5. The device of claim 1 wherein the length of each block is substantially the same distance as the length of said panel.

6. The device of claim 1 wherein the length of each block is substantially the same distance long as the length of each beam.

7. The device of claim 1 wherein the height of each beam is substantially the same distance across as the width of each beam, whereby each beam is substantially shaped as an elongated square beam.

8. The device of claim 1 wherein the length of each beam is substantially the same distance as the length of said panel.

9. The device of claim 1 wherein the length, width and height of each block is substantially the same dimensions of the length, width and height of each beam.

10. The device of claim 9 wherein the length of each block is approximately twenty inches, the width of each block is approximately four inches, the height of each block is approximately four inches.

11. The device of claim 1 wherein the strap is made of material selected from the group consisting of leather, hemp, cotton, nylon, polyester, polypropylene, polyurethanes, polyacryls, polymethacryls, cellulosic polymers, styrene-acryl copolymers, polystyrene-polyacryl mixtures, polysiloxanes, urethane-acryl copolymers, siloxane-urethane copolymers, polyurethane-polymethacryl mixtures, silicone-acryl copolymers, vinyl acetate polymers, and mixtures thereof.

12. A kit for assembling a crib platform device for use in providing a means for building a temporary buttress underneath an overhanging obstruction, said kit comprising:

a first platform unit comprising:

a generally flat panel having a top surface, a bottom surface, a length and a width; and a plurality of elongated blocks attached to the top surface of said panel, each block having a width with a given thickness, a height, a length and an internal collar defining a hole traversing through the width of each block, wherein each block is aligned on said panel so that the holes in said plurality of blocks define an imaginary line, each block is also aligned substantially parallel to each other block and spaced apart from each other block by a distance of at least the given thickness of the width of each block whereby each pair of adjacent blocks defines a channel between each pair of adjacent blocks wherein the channel having a width of at least the given thickness of the width of any given block;

a second platform unit comprising:

a flexible strap; and a plurality of elongated beams attached to said flexible strap, each beam having a width with the given thickness, a height, a length and an internal sleeve defining an orifice traversing through the width of each beam, wherein when said flexible strap is taut lengthwise then each beam is aligned on said flexible strap so that the orifices in said plurality of beams lie along the imaginary line, when said flexible strap is taut lengthwise then each beam is also aligned substantially parallel to each other beam and spaced apart from each other beam by a distance of at least the given thickness of the width of each beam whereby each pair of adjacent beams defines a gap between each pair of adjacent beams having a width of at least the given thickness of the width of any given beam; and a lock bar comprising:

a handle; and a rod attached to said handle, wherein said rod is slidably insertable within the hole of each block of said plurality of blocks of said first platform unit and slidably insertable within the orifice of each beam of said plurality of beams of said second platform unit, whereby said lock bar is capable of locking said first and second platform units together.

13. The kit of claim 12 wherein said strap looped around said plurality of beams define a shoulder harness.

14. The kit of claim 12 wherein the length of said flat panel is substantially the same distance across as the width of said flat panel, whereby said flat panel is substantially shaped as a square.

15. The kit of claim 12 wherein the height of each block is substantially the same distance across as the width of each block, whereby each block is substantially shaped as an elongated square block, wherein the height of each beam is substantially the same distance across as the width of each beam, whereby each beam is substantially shaped as an elongated square beam.

16. The kit of claim 12 wherein the length of each block is substantially the same distance as the length of said panel and wherein the length of each block is substantially the same distance long as the length of each beam.

17. The kit of claim 12 wherein the length, width and height of each block is substantially the same dimensions of the length, width and height of each beam.

18. The kit of claim 17 wherein the length of each block is approximately twenty inches, the width of each block is approximately four inches, the height of each block is approximately four inches.

19. The device of claim 1 wherein the strap is made of material selected from the group consisting of leather, hemp, cotton, nylon, polyester, polypropylene, polyurethanes, polyacryls, polymethacryls, cellulosic polymers, styrene-acryl copolymers, polystyrene-polyacryl mixtures, polysiloxanes, urethane-acryl copolymers, siloxane-urethane copolymers, polyurethanepolymethacryl mixtures, silicone-acryl copolymers, vinyl acetate polymers, and mixtures thereof.

20. A method of using a kit for assembling a crib platform device for use in providing a means for building a temporary buttress underneath an overhanging obstruction, said method comprising the steps of:

obtaining the kit comprising:

a first platform unit comprising:

a generally flat panel having a top surface, a bottom surface, a length and a width; and a plurality of elongated blocks attached to the top surface of the panel, each block having a width with a given thickness, a height, a length and an internal collar defining a hole traversing through the width of each block, wherein each block is aligned on the panel so that the holes in the plurality of blocks define an imaginary line, each block is also aligned substantially parallel to each other block and spaced apart from each other block by a distance of at least the given thickness of the width of each block whereby each pair of adjacent blocks defines a channel between each pair of adjacent blocks wherein the channel having a width of at least the given thickness of the width of any given block;

a second platform unit comprising:

a flexible strap; and a plurality of elongated beams attached to the flexible strap, each beam having a width with the given thickness, a height, a length and an internal sleeve defining an orifice traversing through the width of each beam, wherein when the flexible strap is taut lengthwise then each beam is aligned on the flexible strap so that the orifices in the plurality of beams lie along the imaginary line, when the flexible strap is taut lengthwise then each beam is also aligned substantially parallel to each other beam and spaced apart from each other beam by a distance of at least the given thickness of the width of each beam whereby each pair of adjacent beams defines a gap between each pair of adjacent beams having a width of at least the given thickness of the width of any given beam, wherein the strap looped around the plurality of beams defining a shoulder harness; and a lock bar comprising:

a handle; and a rod attached to the handle, wherein the rod is slidably insertable within the hole of each block of the plurality of blocks of the first platform unit and slidably insertable within the orifice of each beam of the plurality of beams of the second platform unit, whereby the lock bar is capable of locking the first and second platform units together;

placing the bottom surface of the panel of the first platform unit onto a table top so that each block is facing upwards relative to the table top;

mating the first platform unit to the second platform unit so that the plurality of blocks of the first platform unit alternately fit together with the plurality of beams of the second platform unit;

aligning the holes of the plurality of blocks of the first platform unit with the orifices of the plurality of beams of the second platform unit along the imaginary line when the first platform unit is mated to the second platform unit;

sliding the rod of the lock bar into the aligned holes of the plurality of blocks of the first platform unit and into the aligned orifices of the plurality of beams of the second platform unit, whereby said steps of obtaining, placing, mating, aligning and sliding constitute assembling the device from the kit;

wearing the shoulder harness of the flexible strap of the device over a shoulder to hoist up the device;

carrying the device to a given work site while wearing the shoulder harness of the flexible strap of the device over the shoulder;

taking off the shoulder harness of the flexible strap of the device from over the shoulder;

dropping the device down on a work surface;

grabbing hold of the handle of the lock bar of the device;

pulling the handle of the lock bar from the device to remove the rod from the device, whereby unlocking the first platform unit from the second platform unit of the device;

putting down the lock bar in a safe place;

positioning the bottom surface of the first platform unit underneath the overhanging obstruction so that each block is facing upwards relative to the overhanging obstruction;

reposing the second platform unit on top of the first platform unit positioned underneath the overhanging obstruction;

adjusting the beams of the second platform unit in a substantially perpendicular alignment relative to the blocks of the first platform unit positioned underneath the overhanging obstruction whereby said positioning, reposing and adjusting steps constitute constructing building the temporary buttress underneath a portion of the overhanging obstruction; and crawling underneath the overhanging obstruction when the temporary buttress is built underneath a portion of the overhanging obstruction.

* * * * *